US008677535B2

(12) United States Patent
Turner

(10) Patent No.: US 8,677,535 B2
(45) Date of Patent: Mar. 25, 2014

(54) PATIENT SUPPORT APPARATUS WITH STORABLE EGRESS HANDLES

(75) Inventor: Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 583 days.

(21) Appl. No.: 12/900,607

(22) Filed: Oct. 8, 2010

(65) Prior Publication Data

US 2012/0084922 A1 Apr. 12, 2012

(51) Int. Cl.
*A61G 13/12* (2006.01)

(52) U.S. Cl.
USPC ..... 5/662; 5/602; 5/621; 5/623

(58) Field of Classification Search
USPC ..... 5/602, 621–623, 646, 424, 658, 662, 5/620
See application file for complete search history.

(56) References Cited

U.S. PATENT DOCUMENTS

| | | | | |
|---|---|---|---|---|
| 421,656 | A | 2/1890 | Blanken | |
| 1,279,120 | A * | 9/1918 | Kellogg | 607/115 |
| 1,778,698 | A | 10/1930 | Walter | |
| 2,585,660 | A | 2/1952 | Kjos et al. | |
| 2,722,017 | A | 11/1955 | Burst et al. | |
| 2,817,854 | A | 12/1957 | Pratt | |
| 2,817,855 | A | 12/1957 | Pratt | |
| 3,021,534 | A | 2/1962 | Hausted | |
| 3,055,020 | A | 9/1962 | Mann | |
| 3,100,129 | A * | 8/1963 | Adolphson | 297/423.22 |
| 3,179,957 | A | 4/1965 | Norton | |
| 3,220,024 | A | 11/1965 | Nelson | |
| 3,249,387 | A | 5/1966 | Pivacek | |
| 3,286,283 | A | 11/1966 | Bertoldo | |
| 3,312,986 | A | 4/1967 | Fahrni et al. | |
| 3,318,596 | A | 5/1967 | Herzog | |
| 3,344,445 | A | 10/1967 | Crawford | |
| 3,351,962 | A | 11/1967 | Dodrill et al. | |
| 3,486,176 | A | 12/1969 | Murcott | |
| 3,585,659 | A | 6/1971 | Burst et al. | |
| 3,747,133 | A | 7/1973 | Hutt | |
| 3,865,434 | A | 2/1975 | Sully | |
| 3,932,903 | A | 1/1976 | Adams et al. | |
| 3,971,083 | A | 7/1976 | Peterson | |
| 4,002,330 | A | 1/1977 | Johansson | |
| 4,105,242 | A | 8/1978 | Terbeek | |
| 4,119,342 | A | 10/1978 | Jones | |
| 4,120,530 | A | 10/1978 | Imbro | |

(Continued)

FOREIGN PATENT DOCUMENTS

| | | |
|---|---|---|
| EP | 1693037 | 8/2006 |
| EP | 1816994 | 5/2011 |

(Continued)

OTHER PUBLICATIONS

English Abstract for DE 102006011852 (B3) 1 page, Jun. 6, 2007.

*Primary Examiner* — William Kelleher
(74) *Attorney, Agent, or Firm* — Barnes & Thornburg LLP

(57) ABSTRACT

A patient support apparatus includes a base, a frame coupled to the base, and a deck supported by the frame and capable of moving relative to the frame. The patient support apparatus further includes an egress unit coupled to the deck to move between an egress position and a storage position relative to the barrier. The egress unit may include electronic controls to limit movement of various portions of the egress unit.

22 Claims, 10 Drawing Sheets

(56) References Cited

U.S. PATENT DOCUMENTS 4,221,370 A 9/1980 Redwine
4,277,100 A 7/1981 Beougher
4,417,361 A 11/1983 Smith
4,426,071 A * 1/1984 Klevstad ..... 5/602
4,439,880 A 4/1984 Koncelik et al.
4,541,622 A 9/1985 Tabuchi
4,612,679 A 9/1986 Mitchell
4,626,016 A 12/1986 Bergsten
4,632,450 A 12/1986 Holdt
4,680,790 A 7/1987 Packard et al.
4,691,962 A 9/1987 Holdt
4,703,975 A 11/1987 Roberts et al.
4,715,592 A 12/1987 Lewis
4,747,171 A 5/1988 Einsele et al.
4,795,214 A 1/1989 Holdt
4,839,933 A 6/1989 Plewright et al.
4,932,090 A 6/1990 Johansson
4,959,878 A 10/1990 Essek
4,993,089 A 2/1991 Solomon et al.
5,038,430 A 8/1991 Bly
5,060,327 A * 10/1991 Celestina et al. ..... 5/662
5,069,465 A 12/1991 Stryker et al.
5,083,430 A 1/1992 Hirata et al.
5,084,925 A 2/1992 Cook
5,195,200 A 3/1993 Leoutsakos
D336,578 S 6/1993 Celestina
5,216,768 A 6/1993 Bodine et al.
5,225,403 A 7/1993 Treiber et al.
5,231,721 A 8/1993 Fish
5,255,403 A 10/1993 Ortiz
5,333,887 A 8/1994 Luther
5,335,385 A 8/1994 Brown
5,337,430 A 8/1994 Schlein
5,347,682 A 9/1994 Edgerton, Jr.
5,381,571 A 1/1995 Gabhart
5,384,927 A 1/1995 Mardero et al.
5,388,294 A 2/1995 Reeder
5,394,581 A 3/1995 Leoutsakos
5,418,988 A 5/1995 Iura
5,433,235 A 7/1995 Miric et al.
5,463,784 A 11/1995 Alpern
5,471,689 A 12/1995 Shaw et al.
5,485,699 A 1/1996 Gabhart
5,542,136 A 8/1996 Tappel
5,542,138 A 8/1996 Williams et al.
5,586,352 A 12/1996 O'Brien et al.
5,659,910 A 8/1997 Weiss
5,678,267 A 10/1997 Kinder
5,680,661 A 10/1997 Foster et al.
5,689,839 A 11/1997 Laganiere et al.
5,715,548 A 2/1998 Weismiller et al.
5,781,945 A 7/1998 Scherer et al.
5,787,530 A 8/1998 Brix
5,802,636 A 9/1998 Corbin et al.
5,806,111 A 9/1998 Heimbrock et al.
5,832,549 A 11/1998 Le Pallec et al.
5,836,026 A 11/1998 Reed
5,842,237 A 12/1998 Hargest et al.
5,878,452 A 3/1999 Brooke et al.
6,009,570 A 1/2000 Hargest et al.
6,021,533 A 2/2000 Ellis et al.
6,058,531 A 5/2000 Carroll
6,076,209 A 6/2000 Paul
6,089,593 A 7/2000 Hanson et al.
6,101,678 A 8/2000 Malloy et al.
6,154,899 A 12/2000 Brooke et al.
6,163,903 A 12/2000 Weismiller et al.
6,182,310 B1 2/2001 Weismiller et al.
6,185,767 B1 2/2001 Brooke et al.
6,185,769 B1 2/2001 Larisey, Jr. et al.
6,212,714 B1 4/2001 Allen et al.
6,240,583 B1 6/2001 Brooke et al.
6,289,537 B1 9/2001 Hopper et al.
6,315,319 B1 11/2001 Hanson et al.
6,336,235 B1 1/2002 Ruehl
6,374,436 B1 4/2002 Foster et al.
D458,481 S 6/2002 Brooke
D459,119 S 6/2002 Brooke
6,397,416 B2 6/2002 Brooke et al.
6,427,264 B1 8/2002 Metz et al.
6,446,287 B2 * 9/2002 Borders ..... 5/618
6,496,993 B2 12/2002 Allen et al.
6,565,112 B2 5/2003 Hanson et al.
6,668,402 B2 12/2003 Heimbrock
6,675,418 B1 1/2004 Armstrong
6,684,427 B2 2/2004 Allen et al.
6,691,350 B2 2/2004 Weismiller
6,694,548 B2 * 2/2004 Foster et al. ..... 5/600
6,704,954 B2 3/2004 Metz et al.
6,725,474 B2 4/2004 Foster et al.
6,726,279 B1 4/2004 Figel et al.
6,728,985 B2 5/2004 Brooke et al.
6,789,280 B1 9/2004 Paul
6,817,363 B2 11/2004 Biondo et al.
6,820,293 B2 11/2004 Alverson
6,829,793 B2 12/2004 Brooke et al.
6,846,042 B2 1/2005 Hanson et al.
6,860,281 B1 3/2005 Clift
6,874,179 B2 4/2005 Hensley et al.
6,948,202 B2 9/2005 Weismiller
6,961,972 B2 11/2005 Pendell
6,978,499 B2 12/2005 Gallant et al.
7,000,272 B2 2/2006 Allen et al.
7,017,208 B2 3/2006 Weismiller et al.
7,020,920 B2 4/2006 Armstrong
7,028,354 B2 4/2006 Nygren et al.
7,032,265 B2 4/2006 Miller
7,039,971 B2 5/2006 Sebastien
7,073,220 B2 7/2006 Simmonds et al.
7,076,818 B2 7/2006 Kummer et al.
7,107,636 B2 9/2006 Metz et al.
7,150,058 B2 12/2006 Rabska et al.
D535,544 S 1/2007 DeBraal et al.
7,171,709 B2 * 2/2007 Weismiller ..... 5/621
7,213,279 B2 5/2007 Weismiller et al.
7,216,384 B2 5/2007 Allen et al.
7,234,182 B2 6/2007 Miller et al.
7,237,287 B2 7/2007 Weismiller et al.
7,243,386 B2 7/2007 Gallant et al.
7,325,265 B2 2/2008 Hornbach et al.
7,343,916 B2 3/2008 Biondo et al.
7,350,248 B2 4/2008 Hensley et al.
7,406,729 B2 8/2008 Hornbach et al.
7,430,771 B2 10/2008 Heimbrock
7,452,032 B1 * 11/2008 Roleder et al. ..... 297/330
7,458,119 B2 12/2008 Hornbach et al.
7,472,445 B2 1/2009 Miller
7,480,951 B2 1/2009 Weismiller et al.
7,512,998 B2 4/2009 Martin et al.
7,523,515 B2 4/2009 Allen et al.
7,536,738 B2 5/2009 Richards et al.
7,568,246 B2 8/2009 Weismiller et al.
7,568,249 B1 8/2009 Kunde et al.
7,600,817 B2 10/2009 Kramer et al.
7,636,966 B2 12/2009 Gallant et al.
7,665,166 B2 2/2010 Martin et al.
7,676,862 B2 3/2010 Poulos et al.
7,690,059 B2 4/2010 Lemire et al.
7,703,158 B2 4/2010 Wilker, Jr. et al.
7,730,562 B2 6/2010 Hornbach et al.
7,743,441 B2 6/2010 Poulos et al.
7,757,318 B2 7/2010 Poulos et al.
7,774,873 B2 8/2010 Martin et al.
7,779,494 B2 8/2010 Poulos et al.
7,784,128 B2 8/2010 Kramer
7,788,748 B2 9/2010 Wurdeman
7,805,784 B2 10/2010 Lemire et al.
7,805,789 B1 10/2010 Dean
7,861,334 B2 1/2011 Lemire et al.
8,322,342 B2 * 12/2012 Soto et al. ..... 128/845
2001/0027578 A1 10/2001 Brooke et al.
2002/0002742 A1 1/2002 Osborne et al.
2002/0095728 A1 7/2002 Weismiller
2003/0024048 A1 2/2003 Heimbrock

(56) References Cited

U.S. PATENT DOCUMENTS

| | | | | |
|---|---|---|---|---|
| 2003/0056293 | A1 | 3/2003 | Brooke et al. | |
| 2003/0167568 | A1 | 9/2003 | Brooke | |
| 2004/0168254 | A1 | 9/2004 | Rabska et al. | |
| 2005/0015879 | A1* | 1/2005 | Cuschieri et al. | 5/623 |
| 2005/0120485 | A1 | 6/2005 | Sebastien | |
| 2006/0085914 | A1* | 4/2006 | Peterson et al. | 5/618 |
| 2006/0130238 | A1 | 6/2006 | Smith | |
| 2006/0130239 | A1 | 6/2006 | Smith | |
| 2006/0168727 | A1* | 8/2006 | Heimbrock | 5/602 |
| 2007/0151032 | A1 | 7/2007 | Heavrin | |
| 2009/0007332 | A1 | 1/2009 | Wu et al. | |
| 2009/0199339 | A1* | 8/2009 | Barr | 5/602 |
| 2009/0229049 | A1 | 9/2009 | Heimbrock et al. | |
| 2010/0000016 | A1 | 1/2010 | Aiken et al. | |
| 2010/0242176 | A1* | 9/2010 | Newkirk et al. | 5/602 |
| 2011/0185507 | A1 | 8/2011 | Abernathey et al. | |
| 2012/0073051 | A1* | 3/2012 | Lachenbruch et al. | 5/610 |

FOREIGN PATENT DOCUMENTS

| | | |
|---|---|---|
| WO | WO 82/02832 | 9/1982 |
| WO | WO 01/47340 | 7/2001 |
| WO | WO 03/015686 | 2/2003 |
| WO | WO 03/032777 | 4/2003 |
| WO | WO 2006025245 | 3/2006 |
| WO | WO 2006/058506 | 6/2006 |

* cited by examiner

PATIENT SUPPORT APPARATUS WITH STORABLE EGRESS HANDLES

BACKGROUND

The present disclosure is related to a support apparatus for supporting a patient. More particularly, the present disclosure relates to a bed that can be manipulated to achieve both a conventional bed position having a horizontal support surface and a chair position having the feet of the patient on or adjacent to the floor and the head and back of the patient supported above a seat formed by the bed.

It is known to provide beds that have a head siderail assembly coupled to a head portion of the support surface and a foot siderail assembly coupled to a seat portion of the support surface. The siderail assemblies may be movable independently of one another between a raised position and a lowered position. The siderail assemblies may be used in the raised position to retain patients resting on the support surface and in the lowered position to transfer patients from the bed to another support apparatus, allow a caregiver improved access to the patient, or to help with entering and exiting the bed.

It is also known that patients egress from a side of the bed. Before the patient is able to egress, the patient must rotate the patient's body on the support surface to face toward the side, swing the patient's legs over the side of the bed, and remain sitting in an upright position without support from the support surface to the patient's back. Such coordinated movement to egress from the side of the bed may be difficult for some patients. As a result, egress from the chair position of the bed may be more suitable to some patients. With the bed in the chair position, the patient begins with the patient's feet resting on the floor, the patient sitting in the upright position, and the patient's back being supported by the support surface. To egress from the bed, the patient supports a portion of the patient's weight on the support surface on each side of the patient or on a caregiver standing next to the bed. The patient then leans forward and transfers the remaining weight to the patient's feet.

SUMMARY

The present application discloses one or more of the features recited in the appended claims and/or the following features which, alone or in any combination, may comprise patentable subject matter.

According to one aspect of the present disclosure, a patient support apparatus includes a base, a frame, a deck and an egress unit. The frame is coupled to the base and is movable relative to the base. The deck is supported by the frame and movable relative to the frame between a horizontal position and an articulated position. The deck includes at least a head section, a foot section, and a seat section. The foot section is spaced-apart from the head section. The seat section lies between the head section and the foot section. The foot section is pivotable about a first lateral pivot axis relative to the frame. The egress unit is coupled to the seat section of the deck and is movable between an egress position and a storage position. When the egress unit is in the egress position and the deck is in the articulated position, the egress unit extends in an upward direction away from the deck to support a portion of the patient's weight so that a patient can egress from the patient support apparatus. When the egress unit is in the storage position, the handle is arranged to lie in confronting relation with the deck.

In some embodiments, the egress unit includes a handle and a slide assembly. The slide assembly may be arranged to lie between and to interconnect the handle to the seat section of the deck. The slide assembly may be movable between a retracted position and an extended position. When the slide assembly is in the retracted position, the handle may be positioned adjacent to a foot edge of the seat section. When the slide assembly is in the extended position, handle may have moved away from the seat section in a longitudinal direction to lie in spaced-apart relation to the foot edge of the seat section.

The handle may be coupled to the slide assembly to rotate about an axis between a first position and a second position. When the handle is in the first position, the handle may extend in a downward direction away from a bottom surface of the seat section. When the handle is in the second position, the handle may extend away from a top surface of the seat section in an upward direction.

The slide assembly may include a slide tube and a slide-tube receiver. The slide tube may be coupled to the handle to move therewith. The slide-tube receiver may be coupled to the seat section to move therewith. The slide-tube receiver may be configured to support the slide tube therein for back-and-forth movement of the slide tube generally parallel to a longitudinal axis of the bed along the axis.

In some embodiments, the handle may be movable about an axis between a first position and a second position. When the handle is in the first position, the handle may extend in a direction that is generally perpendicular to a longitudinal axis of the patient support apparatus. When the handle is in the second position, the handle may extend away from a top surface of the seat section in an upward direction.

The slide-tube receiver may be coupled to a top surface of the seat section. The handle may lie in a plane generally parallel to the top surface of the seat section when the slide assembly is in the retracted position and the handle is in the first position.

The slide-tube receiver may be coupled to a bottom surface of the seat section. The bottom surface of the seat section may be spaced-apart from the top surface and may be arranged to face in the downward direction.

The seat section may be formed to include a recess that opens in a downward direction away from the top surface. The egress unit may be arranged to lie in the recess and lie below the top surface when the slide assembly is in the retraced position and the handle is in the first position.

In some embodiments, the handle includes a grip, a mount, and a handle joint. The grip may be adapted to be grasped by a patient during egress from the patient support apparatus. The mount may be coupled on a first end to the grip. The handle joint may be arranged to interconnect an opposite second end of the mount to the slide assembly to cause the mount and the grip to move about an axis between a first position and a second position. When the grip and the mount are in the first position, the mount may be generally aligned with the slide assembly. When the grip and mount are in the second position, the mount may extend in an upward direction away from the slide and may be about perpendicular to the slide assembly. The axis may be generally parallel to the first lateral pivot axis.

The handle joint may define the axis. The handle joint may be between the foot edge and an opposite head edge of the seat section when the slide assembly is in the retracted position. The handle joint may move away from the foot edge and the head edge to lie spaced-apart from the foot edge when the slide assembly is in the extended position.

According to another aspect of the present disclosure, a patient support apparatus includes a base, a frame, a deck, a siderail, a slide assembly, and a handle. The frame may be coupled to the base and may be movable relative to the base. The deck is supported by the frame and is movable relative to the frame between a horizontal position and an articulated position. The deck includes at least a head section, a foot section spaced-apart from the head section, and a seat section positioned between the head and foot sections. The seat section includes a foot edge, an oppositely spaced-apart head edge, a first longitudinal edge arranged to extend between the foot and the head edges, and an opposite second longitudinal edge arranged in spaced-apart generally parallel relation to the first longitudinal edge. The foot section is pivotable about a first lateral pivot axis relative to the frame. The siderail is coupled the frame between the head edge and the foot edge of the seat section and is arranged to extend along one of the first and second longitudinal edges of the seat section. The slide assembly includes a slide-tube receiver that is coupled to the seat section in a fixed position and a slide tube that is coupled to the slide-tube receiver to translate along an axis relative to the slide-tube receiver. The slide assembly is in a retracted position when the slide tube lies between the foot and the head ends of the seat section. The slide assembly is in an extended position when the slide tube has translated along the axis away from the foot and the head edges of the seat section toward a foot end of the patient support apparatus. The handle is coupled to the slide tube to move therewith about the axis. The handle is movable relative to the slide-slide tube receiver about a pivot axis when the slide-tube receiver is in the extended position. The handle moves from a first position to a second position. The handle when in the first position extends generally perpendicularly away from the axis to define an angle measured in a second direction between a horizontal plane that is generally coplanar with the axis and the handle and the angle is between about 0 degrees and about 180 degrees. The handle when in the second position extends in an upward direction away from the axis.

In some embodiments, the slide-tube receiver is coupled to a top surface of the section. The handle may extend away from a longitudinal axis of the patient support apparatus toward the siderail when the handle is in the first position.

In some embodiments, the handle may be coupled to the longitudinal edge of the section and may extend away from the longitudinal edge toward the siderail. The handle may lie between the longitudinal edge and the siderail.

In some embodiments, the slide-tube receiver is coupled to a bottom surface of the seat section.

In some embodiments, the top surface of the seat section is formed to include a recess. The recess may be configured to receive the egress unit therein when the slide assembly is in the retraced position and the handle is in the first position.

The handle may include a grip, a mount, and a handle joint. The grip may be adapted to be grasped by a patient during egress from the patient support apparatus. The mount may be coupled on a first end to the grip. The handle joint may interconnect an opposite second end of the mount to the slide assembly to cause the mount and the grip to move about the pivot axis between a first position and a second position. The mount when in the first position may be generally aligned with the slide assembly. The mount when in the second position may extend in an upward direction away from the slide tube and may be about perpendicular to the slide tube.

According to another aspect of the present disclosure, a patient support apparatus includes a base, a frame, a deck, a slide assembly, and a handle. The frame is coupled to the base and is movable relative to the base. The deck is supported by the frame and is movable relative to the frame between a horizontal position and a chair-egress position. The deck includes a head section, a foot section spaced-apart from the head section, and a seat section positioned between the head and foot sections. The seat section includes a foot edge, an opposite head edge, and a longitudinal edge extending between the head and foot edges. The head section is arranged to pivot upwardly about a first lateral pivot axis relative to the seat section. The foot section is arranged to pivot upwardly about a second lateral pivot axis downwardly relative to seat section when the deck is in the chair-egress position. The slide assembly includes a slide-tube receiver and a slide tube. The slide-tube receiver is coupled to the longitudinal edge of the seat section in a fixed position and is arranged to extend away from the seat section in a lateral direction. The slide tube is coupled to the slide-tube receiver to translate along an axis relative to the slide-tube receiver. The slide assembly is in a retracted position when the slide tube lies between the foot and the head ends of the seat section. The slide assembly is in an extended position when the slide tube has translated along the axis away from the foot and the head edges of the seat section toward a foot end of the patient support apparatus. The handle is coupled to the slide tube to translate back and forth with the slide tube about the axis. The handle is movable relative to the slide tube about a third lateral pivot axis when the slide assembly is in the extended position from a first position to the second position. The handle, when in the first position, is generally aligned with the slide tube. The handle, when in the second position, extends in an upward direction away from the slide tube. The third lateral pivot axis is generally parallel to the first and second lateral pivot axes.

Additional features, which alone or in combination with any other feature(s), including those listed above, those listed in the claims, and those described in detail below, may comprise patentable subject matter. Other features will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
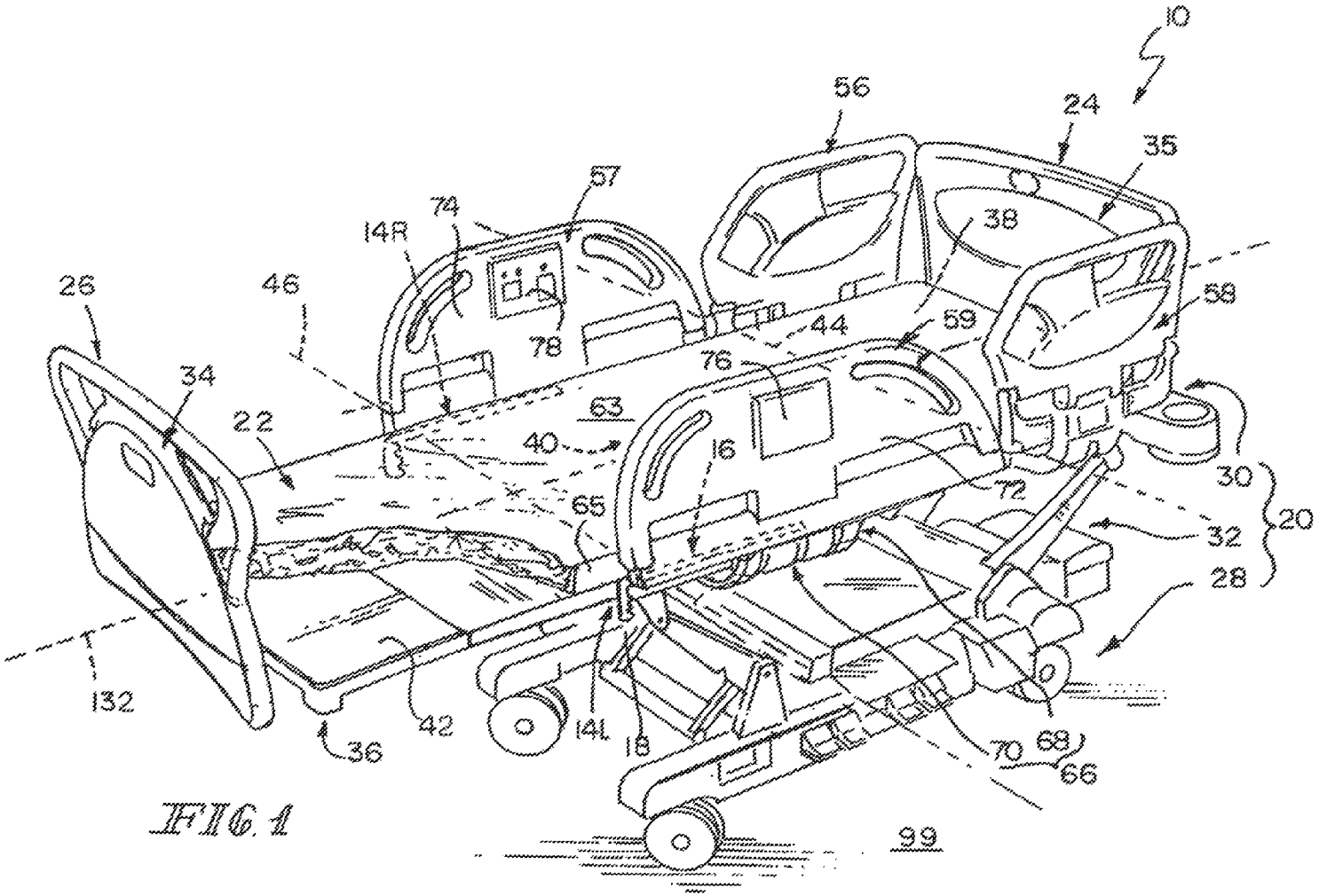
FIG. 1 is a perspective view of a patient support apparatus in a generally flat configuration with a pair of egress units in a storage position.
Figure 2:
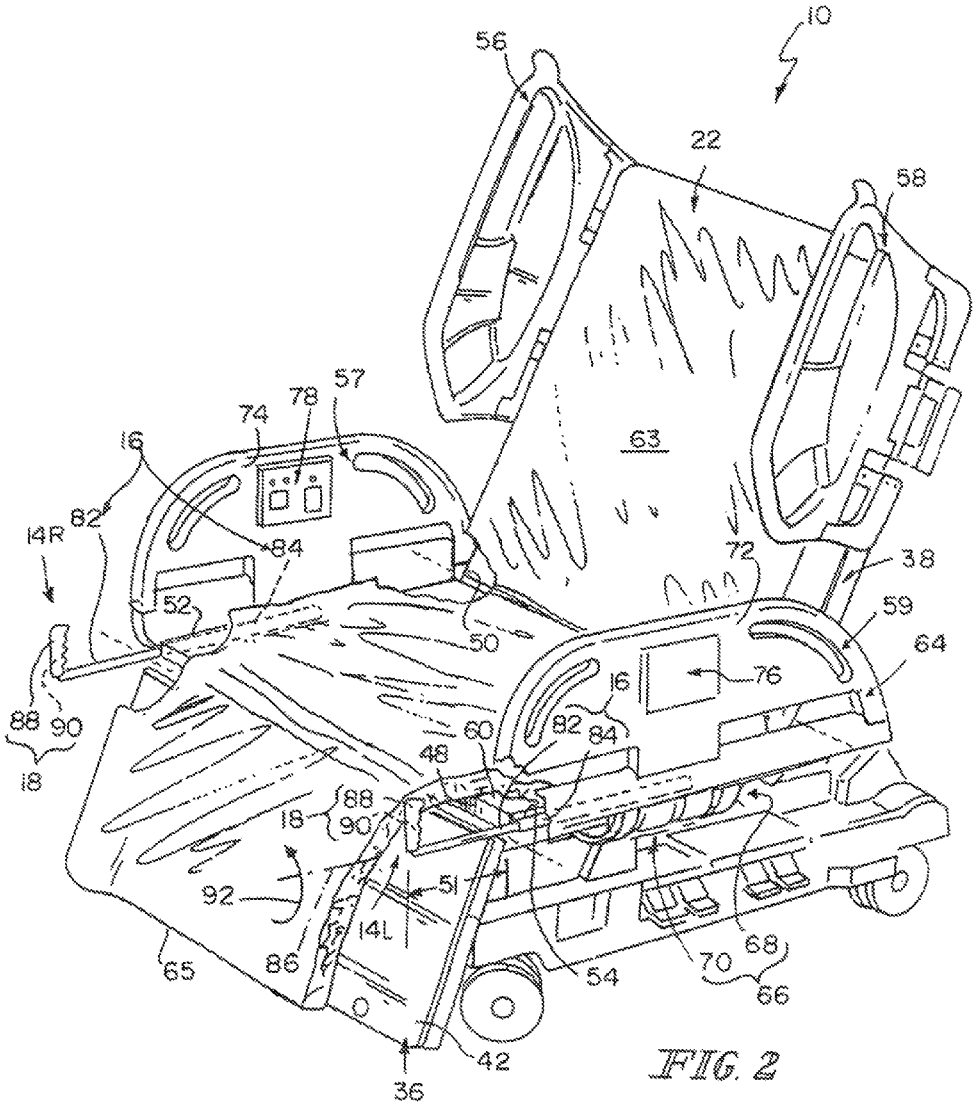
FIG. 2 is a perspective view of the patient support apparatus of FIG. 1 moved to a chair-egress position with the pair of egress handles in an egress position.

A patient support apparatus, such as a hospital bed 10 is shown, for example, in FIGS. 1 and 2. The hospital bed 10 is movable between a bed position, as shown in FIG. 1, and a chair-egress position as shown in FIG. 2. The hospital bed 10, when in the bed position, provides support to a patient (not shown) such that the patient's feet are supported spaced-apart from the ground 99. The hospital bed 10, when in the chair-egress position, provides support to a patient such that the patient sits upright and the patient's feet are positioned on the ground 99. The chair-egress position is also used by patients and caregivers to help patients egress or exit the hospital bed 10. As shown in FIGS. 1 and 2, a pair of egress units 14R, 14L are included in the hospital bed 10. Each of the egress units 14R, 14L includes a slide assembly 16 that is movable between a retracted position shown in FIG. 3 and an extended position shown in FIGS. 1, 2, 4, and 5 and an egress handle 18 that is movable between a first position shown in FIG. 3 and a second position shown in FIGS. 1, 2, 4, and 5. When the egress handle 18 is in the second position and the slide assembly 16 is in the extended position, a patient may support a portion of his or her weight on the egress units 14R, 14L during egress from the hospital bed 10.

The hospital bed 10 further includes a frame 20 and a mattress 22 that is supported by the frame 20 as shown in FIGS. 1 and 2. The hospital bed 10 has a head end 24 and a foot end 26. The frame 20 includes a base 28 and an upper frame 30 coupled to the base 28 by an elevation system 32. The elevation system 32 is operable to raise, lower, and tilt the upper frame 30 relative to the base 28. The hospital bed 10 further includes a foot panel 34 positioned adjacent the foot end 26 and a head panel 35 positioned adjacent the head end 24. The foot panel 34 is removable and is removed prior to moving the hospital bed 10 into the chair-egress position shown in FIG. 2.

The mattress 22 of the hospital bed 10 includes a top surface 63, a bottom surface (not shown), and a perimeter surface 65 as shown in FIGS. 1 and 2. The upper frame 30 of the frame 20 supports a deck 36 with the mattress 22 supported on the deck 36. The deck 36, as shown in FIGS. 1 and 2, includes a head section 38, a seat section 40, and a foot section 42. The head section 38 pivotably raises and lowers about a first lateral pivot axis 44 relative to the seat section 40. Additionally, the seat section 40 pivotably raises and lowers relative to the upper frame 30. Also, the foot section 42 is extendable and retractable to change an overall length of the foot section 42, and therefore, to change an overall length of the deck 36.

In some embodiments, the seat section 40 also moves, such as by translating on the upper frame 30, as the hospital bed 10 moves between the bed position and the chair-egress position. In those embodiments where the seat section 40 translates along the upper frame 30, the foot section 42 also translates along with the seat section 40. As the hospital bed 10 moves from the bed position to the chair-egress position, the foot section 42 lowers about a second lateral pivot axis 46 relative to the seat section 40 and shortens in length. As the hospital bed 10 moves from the chair-egress position to the bed position, the foot section 42 raises relative to the seat section 40 and increases in length. Thus, in the chair-egress position, the head section 38 extends generally vertically upwardly from the upper frame 30 and the foot section 42 extends generally downwardly from the upper frame 30 as shown in FIG. 2.

The seat section 40 includes a foot edge 48, an opposite head edge 50, a first longitudinal edge 52, a second longitudinal edge 54, a top surface 60, and an opposite bottom surface 61. The foot edge 48 is spaced-apart from and opposite the head edge 50. The first longitudinal edge 52 is spaced-apart from and opposite the second longitudinal edge 54. The first and second longitudinal edges 52, 54 extend between the head and the foot edges 48, 50. Together, all the edges 48, 50, 52, 54 cooperate together to define a perimeter of the seat section 40. The top surface 60 is arranged to face in an upward direction and extend between the four edges 48, 50, 52, 54 of the seat section 40. The bottom surface 61 is spaced-apart below the top surface 60, is arranged to face in an opposite downward direction, and extends between the four edges 48, 50, 52, and 54 as shown in FIG. 2. The first lateral pivot axis 44 is parallel to and between the head edge 50 and the head section 38. The second lateral pivot axis 46 is parallel to the first lateral pivot axis 44 and to the foot edge 48 and is between the foot edge 48 and the foot section 42 as shown in FIG. 1.

The hospital bed 10 also includes four siderail assemblies coupled to the upper frame 30: a patient-right head siderail assembly 56, the patient-right foot siderail assembly 57, a patient-left head siderail assembly 58, and a patient-left foot siderail assembly 59. Each of the siderail assemblies 56, 57, 58, and 59 is movable between a raised position, as shown in FIGS. 1 and 2, and a lowered position. Siderail assemblies 56, 57, 58, and 59 are sometimes referred to as siderails 56, 57, 58, and 59 herein. As shown in FIG. 2, the patient-left foot siderail 59 is spaced-apart from and arranged to extend along the second longitudinal edge 54.

The left foot siderail 59 is similar to the other siderails 56, 57, and 58, and thus, the following discussion of the left foot siderail 59 is equally applicable to other siderails 56, 57, and 58. The siderail 59 includes a barrier panel 64 and a linkage 66 that includes a support assembly 68 and a guide assembly 70. The guide assembly 70 is coupled to the upper frame 30 in a fixed position and is configured to guide the support assembly 68 and the barrier panel 64 during movement of the foot siderail 59 between the raised and the lowered positions. The support assembly 68 interconnects the barrier panel 64 and the guide assembly 70 to cause the barrier panel 64 to remain in a substantially vertical orientation during movement between the raised and the lowered positions.

The barrier panel 64 includes an outward side 72 and an oppositely facing inward side 74. As shown in FIGS. 1 and 2, the inward side 74 faces toward the mattress 22 and the outward side 72 faces away from the mattress 22. A first user interface 76 is coupled to the outward side 72 of the barrier panel 64 for use by a caregiver (not shown). As shown in FIGS. 1 and 2, a second user interface 78 is coupled to the inward side 74 for use by a patient (not shown). Both the first and second user interfaces 76, 78 are coupled electrically to a bed controller 80 included in the hospital bed 10. The user interfaces 76, 78 allow caregivers and patients to control movement of the elevation system 32 as well as other features of the hospital bed 10.

Figure 3:
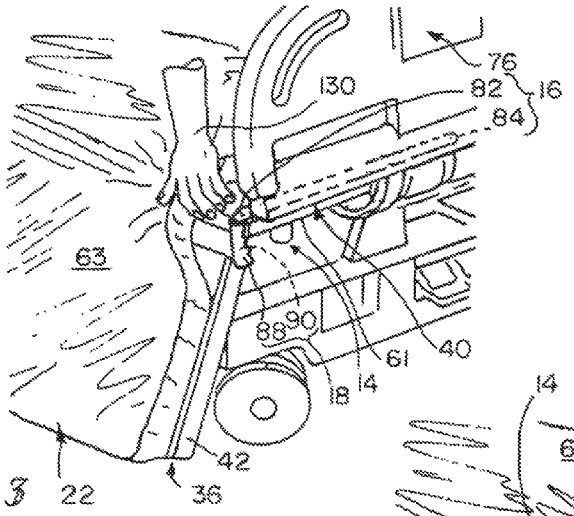
FIG. 3 is an enlarged partial perspective view of the patient support apparatus in the position of FIG. 2 with the mattress pulled back by a caregiver to provide better access to a patient-left egress unit in a storage position.
Figure 4:
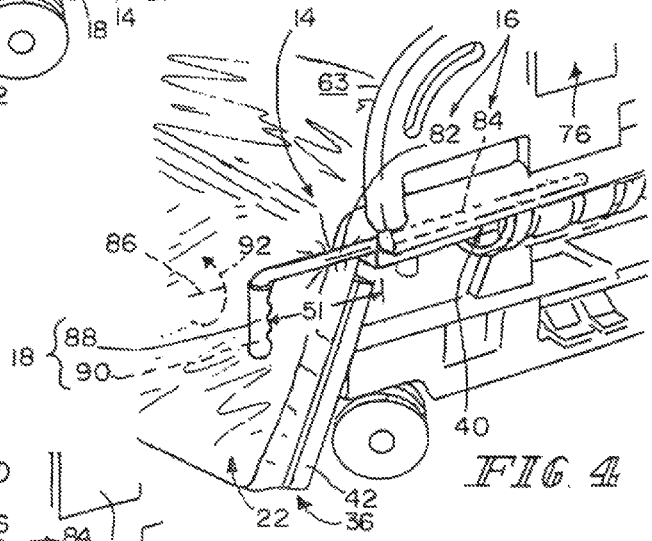
FIG. 4 is a view similar to FIG. 3 with a portion of the egress unit in an extended position.
Figure 5:
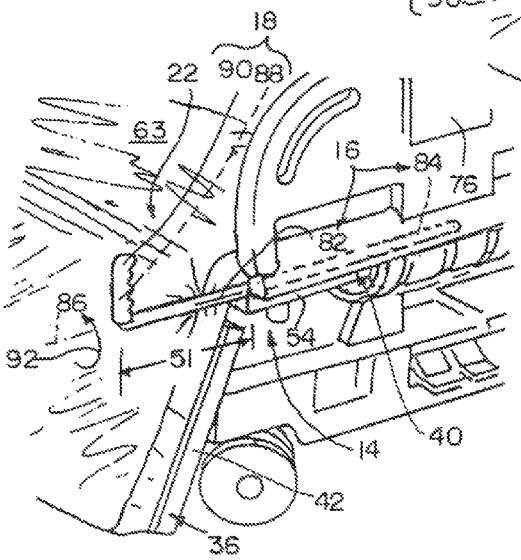
FIG. 5 is a view similar to FIG. 4 with the egress unit in the egress position.

As discussed previously, the hospital bed 10 also includes the patient-right egress unit 14R and the patient-left egress unit 14L. The patient-left egress unit 14L is similar to the patient-right egress unit 14R, and thus, the following discussion of the patient-left egress unit 14L is equally applicable to the patient-right egress unit 14R. Also, the patient-left egress unit 14L may also be called the egress unit 14 herein. The egress unit 14 includes a slide assembly 16 and an egress handle 18. The slide assembly 16 is movable between the retracted position shown in FIGS. 1 and 3 and the extended position shown in FIGS. 2, 4, and 5. The slide assembly 16 includes a slide tube 82 and a slide-tube receiver 84 as shown in FIGS. 3-5. The slide-tube receiver 84 is coupled to the second longitudinal side 54 of the seat section 40 to move therewith. The slide tube 82 interconnects the egress handle 18 and the slide assembly 16 to cause the slide tube 82 and the egress handle 18 to move back and forth relative to the slide-tube receiver 84 to establish either the extended position or the retracted position of the slide assembly 16.

The slide assembly 16 is in the retracted position when the slide tube 82 lies between the foot and the head edges 48, 50 and the egress handle 18 is in confronting relation with the foot edge 48 of the seat section 40 as shown in FIG. 3. The slide assembly 16 moves from the retracted position and assumes the extended position as a result of the slide tube 82 moving along an axis 86 away from the slide-tube receiver 84 toward the foot end 26 of the hospital bed 10 a distance 51 measured between the foot edge 48 of the seat section 40 and the handle 18 as shown in FIG. 2. The axis 86 lies spaced-apart from and parallel to a longitudinal axis 132 of the hospital bed 10. The axis 86 also extends along the second longitudinal edge 54 of the seat section 40. The slide tube 82 defines the axis 86.

The egress handle 18, as shown in FIGS. 1-5, includes a grip 88 and a mount 90. The mount 90 is coupled to the slide tube 82 to move therewith back and forth along the axis 86 relative to the slide-tube receiver 84. The grip 88 is coupled to the mount 90 to move therewith and is configured to grasped by a patient during egress from the hospital bed 10. The handle 18 is movable between a first position shown in FIGS. 1, 3, and 4 and a second position shown in FIGS. 2 and 5. When the handle 18 is in the first position, the mount 90 of the handle 18 extends away from the slide tube 82 at about a right angle to the axis 86 in a downward direction. As shown in FIG. 3, the handle 18 extends away from the bottom surface 61 of the seat section 40 towards the ground 99. The handle 18 moves from the first position to the second position by rotating in a first direction 92 indicated by arrow 92 about the axis 86 until the mount 90 extends away from the slide tube 82 and the top surface 60 of the seat section 40 in the upward direction. Put another way, the handle 18 is at six o'clock when in the first position and moves about the axis 86 in the first direction 92 until the handle 18 is at 12 o'clock and in the second position when viewed from the foot end 26 of the hospital bed 10.

A caregiver 130 may use the egress unit 14 when a patient egresses from the hospital bed 10 by way of the chair-egress position shown in FIG. 2. As an example of use, the hospital bed 10 begins in the bed position with the egress unit 14 in the storage position as shown in FIG. 1. The hospital bed 10 is then moved from bed position to the egress position of FIG. 2 and a portion of the mattress associated with the foot section 42 and the seat section 40 is deflated. Next, the caregiver 130 moves the mattress 22 away from the egress unit 14 to expose the egress unit 14 as shown in FIG. 3. The caregiver 130 then moves the slide assembly 16 from the retracted position to the extended position shown in FIG. 4. Finally, the caregiver 130 moves the egress handle 18 from the first position shown in FIGS. 3 and 4 to the second position shown in FIG. 5 so that a patient may use the egress unit 14 to egress from the hospital bed 10. The egress unit 14 is in the egress position when the slide assembly 16 is in the extended position and the handle 18 is in the second position. The egress unit 14 is in the storage position when the slide assembly 16 is in the retracted position and the handle 18 is in the first position.

Figure 6:
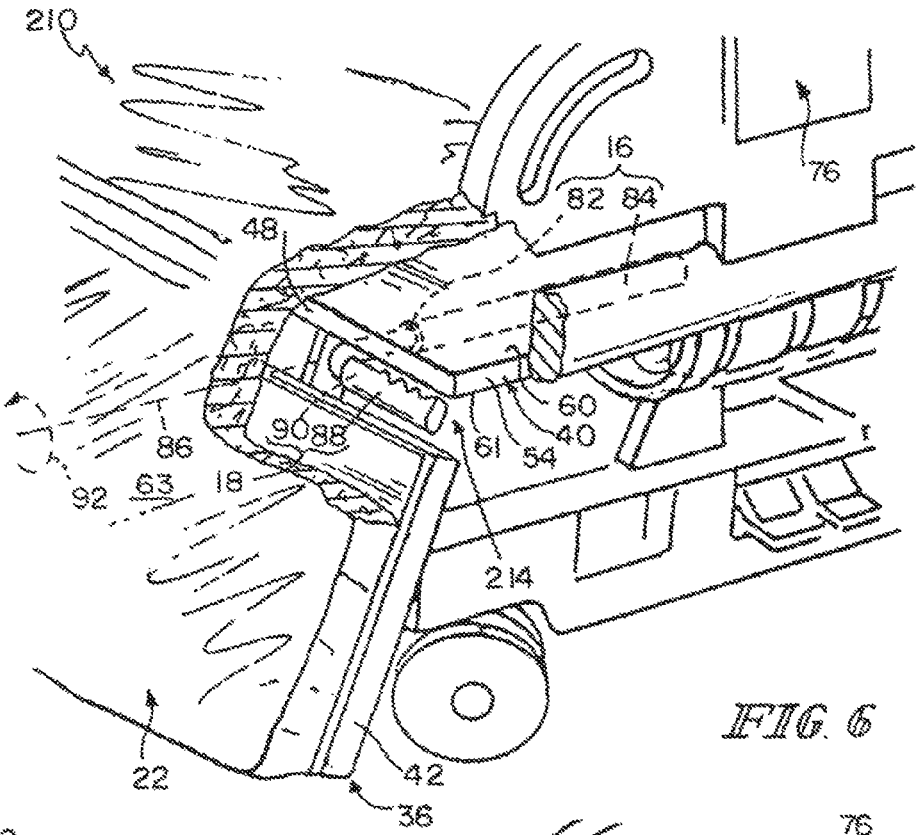
FIG. 6 is an enlarged partial perspective view of another embodiment of an egress unit in a storage position.
Figure 7:
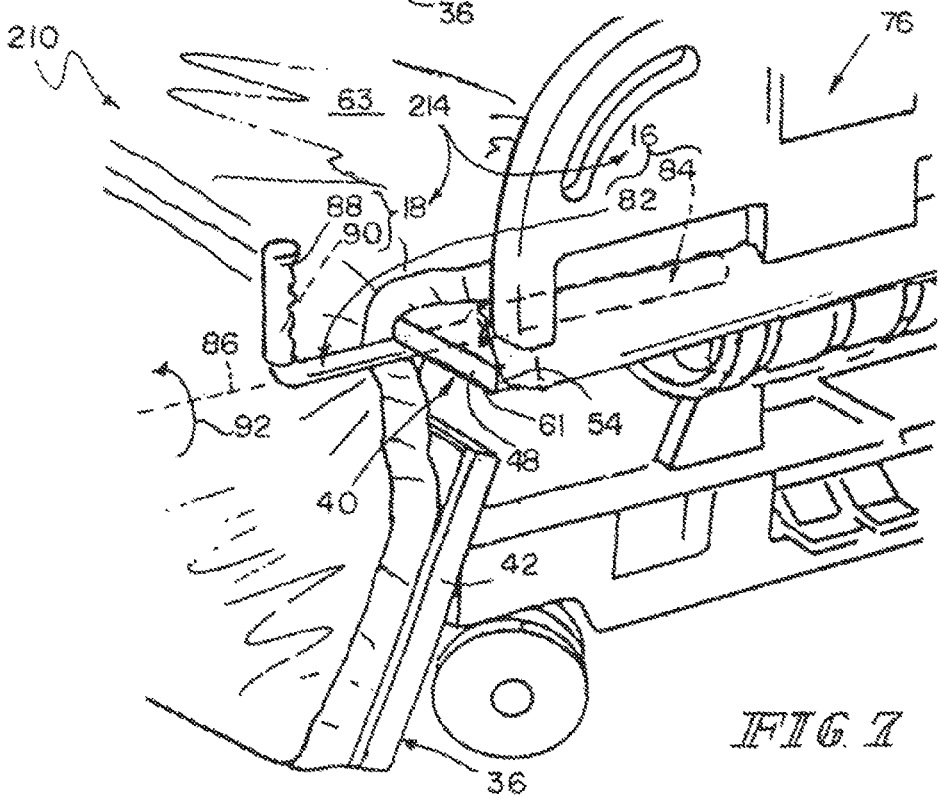
FIG. 7 is a view similar to FIG. 6 with the egress unit in an egress position.

Another embodiment of an egress unit 214 is shown in FIGS. 6 and 7. The egress unit 14 is omitted from the hospital bed 210 and is replaced with the egress unit 214. The egress unit 214 includes the slide assembly 16 and the egress handle 18 as shown in FIG. 7. The slide assembly 16 is also movable between a retracted position shown in FIG. 6 and an extended position shown in FIG. 7. Similarly, the egress handle 18 is movable between a first position shown in FIG. 6 and a second position shown in FIG. 7. The egress unit 214 assumes a storage position when the handle 18 is in the first position and the slide assembly 16 is in the retracted position as shown in FIG. 6. The egress unit 214 assumes the egress position when the handle 18 is in the second position and the slide assembly 16 is in the extended position as shown in FIG. 7.

As discussed previously, the slide assembly 16 includes the slide tube 82 and the slide-tube receiver 84 as shown in FIGS. 6 and 7. The slide-tube receiver 84 is coupled to the bottom surface 61 of the seat section 40 to move therewith. The slide tube 82 interconnects the egress handle 18 to the slide assembly 16 to cause the slide tube 82 and the egress handle 18 to move back and forth along the axis 86 relative to the slide-tube receiver 84 to establish either the extended position or the retracted position of the slide assembly 16.

The slide assembly 16 is in the retracted position when the slide tube 82 lies between the foot and the head edges 48, 50 and the egress handle 18 is in confronting relation with the bottom surface 61 of the seat section 40 as shown in FIG. 6. The slide assembly 16 moves from the retracted position and assumes the extended position as a result of the slide tube 82 moving along the axis 86 away from the slide-tube receiver 84 toward the foot end 26 of the hospital bed 210.

The egress handle 18, as shown in FIGS. 6 and 7, includes the grip 88 and the mount 90. The handle 18 is movable between a first position shown in FIG. 6 and a second position shown in FIG. 7. When the handle 18 is in the first position, the mount 90 extends away from the slide tube 82 at about a right angle to the axis 86 in a lateral direction. As shown in FIG. 6, the handle 18 extends away from the longitudinal axis 132 of the hospital bed 10 toward the siderail 59. The handle 18 moves from the first position to the second position by rotating in a first direction 92 indicated by arrow 92 about the axis 86 until the mount 90 of the handle 18 extends away from the slide tube 82, the bottom surface 61, and the top surface 60 of the seat section 40 in the upward direction. Put another way, the handle 18 is at three o'clock when in the first position and moves about the axis 86 in the first direction 92 about 90 degrees until the handle 18 is at 12 o'clock and in the second position when viewed from the foot end 26 of the hospital bed 10.

A caregiver 130 may use the egress unit 214 when a patient egresses from the hospital bed 210 by way of the chair-egress position. As an example of use, the hospital bed 210 begins in the bed position with the egress unit 214 in the storage position. The hospital bed 210 is then moved from bed position to the egress position and a portion of the mattress associated with the foot section 42 and the seat section 40 is deflated.

Next, the caregiver 130 moves the mattress 22 away from the egress unit 214 to expose the egress unit 214. The caregiver 130 then slides the slide assembly 16 from the retracted position to the extended position. Finally, the caregiver 130 moves the egress handle 18 from the first position shown in FIG. 6 to the second position shown in FIG. 7 so that a patient may use the egress unit 214 to egress from the hospital bed 210.

Figure 8:
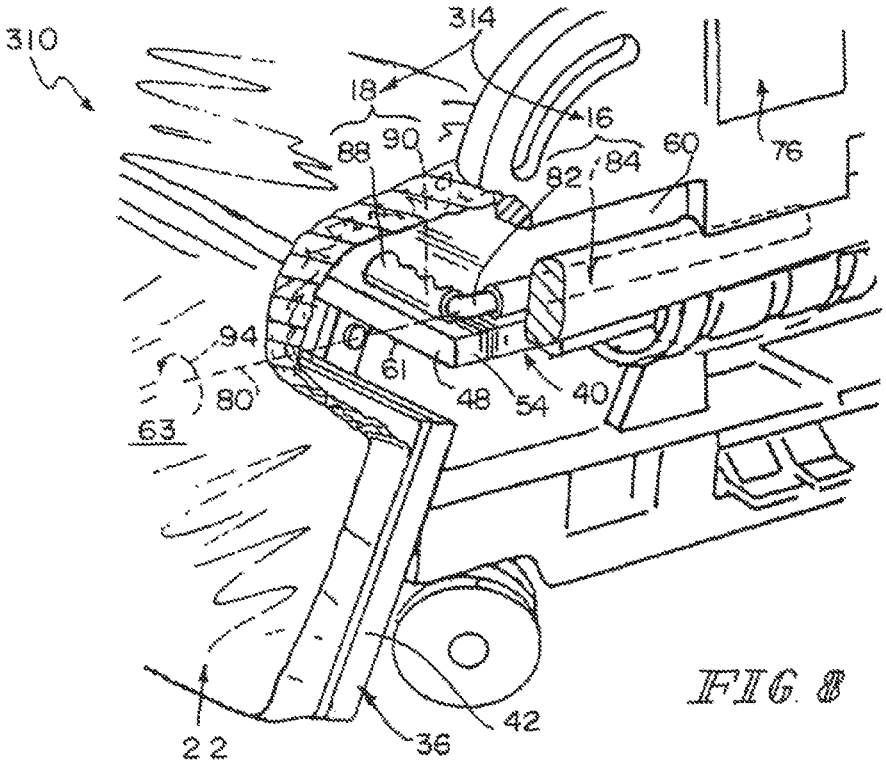
FIG. 8 is an enlarged partial perspective view of another embodiment of an egress unit in a storage position.
Figure 9:
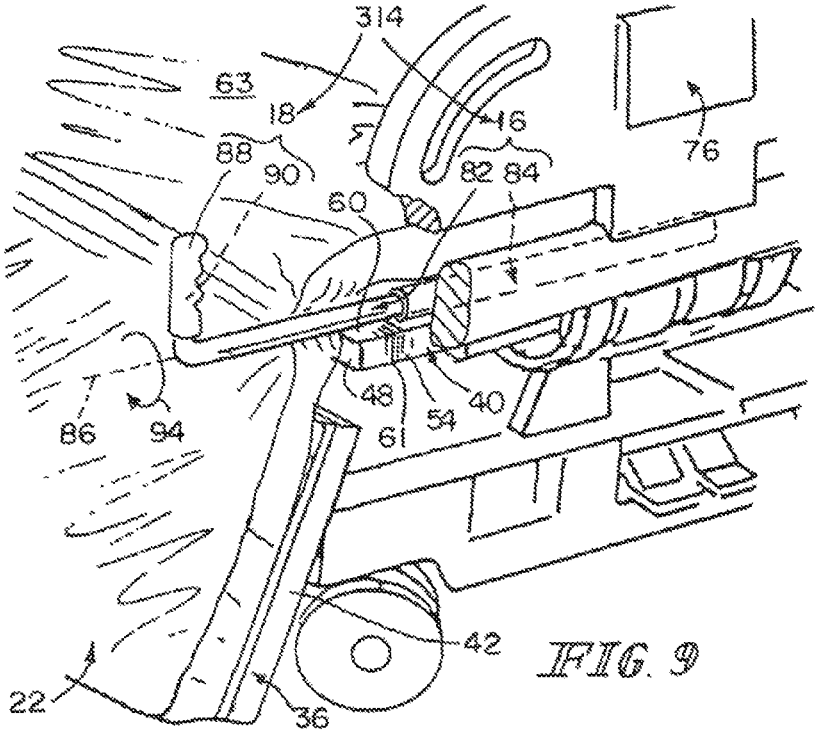
FIG. 9 is a view similar to FIG. 10 with the egress unit in an egress position.

Another embodiment of an egress unit 314 is shown in FIGS. 8 and 9. The egress units 14 and 214 are omitted from the hospital bed 310 and replaced with the egress unit 314. The egress unit 314 includes the slide assembly 16 and the egress handle 18 as shown in FIG. 8. The slide assembly 16 is also movable between a retracted position shown in FIG. 8 and an extended position shown in FIG. 9. Similarly, the egress handle 18 is movable between a first position shown in FIG. 8 and a second position shown in FIG. 9. The egress unit 314 assumes a storage position when the handle 18 is in the first position and the slide assembly 16 is in the retracted position as shown in FIG. 8. The egress unit 314 assumes the egress position when the handle 18 is in the second position and the slide assembly 16 is in the extended position as shown in FIG. 9.

As discussed previously, the slide assembly 16 includes the slide tube 82 and the slide-tube receiver 84 as shown in FIGS. 8 and 9. The slide-tube receiver 84 is coupled to the top surface 60 of the seat section 40 to move therewith. The slide tube 82 interconnects the egress handle 18 to the slide assembly 16 to cause the slide tube 82 and the egress handle 18 to move back and forth relative to the slide-tube receiver 84 to establish either the extended position or the retracted position of the slide assembly 16.

The slide assembly 16 is in the retracted position when the slide tube 82 lies between the foot and the head edges 48, 50 and the egress handle 18 is in confronting relation with the top surface 60 of the seat section 40 as shown in FIG. 8. The slide assembly 16 moves from the retracted position and assumes the extended position as a result of the slide tube 82 moving along the axis 86 away from the slide-tube receiver 84 toward the foot end 26 of the hospital bed 310.

The egress handle 18 is movable between the first position shown in FIG. 8 and the second position shown in FIG. 9. When the handle 18 is in the first position, the mount 90 extends away from the slide tube 82 at about a right angle to the axis 86 in a lateral direction. As shown in FIG. 8, the handle 18 extends away from the second longitudinal edge 54 toward the longitudinal axis 132 of the hospital bed 310. The handle 18 moves from the first position to the second position by rotating in a second direction indicated by arrow 94 about the axis 86 until the mount 90 of the handle 18 extends away from the slide tube 82 and the top surface 60 of the seat section 40 in the upward direction. Put another way, the handle 18 is at nine o'clock when in the first position and moves about the axis 86 in the second direction 94 about 90 degrees until the handle 18 is at 12 o'clock and in the second position when viewed from the foot end 26 of the hospital bed 10.

A caregiver 130 may use the egress unit 314 when a patient egresses from the hospital bed 310 by way of the chair-egress position shown in FIG. 2. As an example of use, the hospital bed 310 begins in the bed position with the egress unit 314 in the storage position. The hospital bed 310 is then moved from bed position to the egress position and a portion of the mattress associated with the foot section 42 and the seat section 40 is deflated. Next, the caregiver 130 moves the mattress 22 away from the egress unit 314 to expose the egress unit 314. The caregiver 130 then slides the slide assembly 16 from the retracted position to the extended position. Finally, the caregiver 130 moves the egress handle 18 from the first position shown in FIG. 8 to the second position shown in FIG. 9 so that a patient may use the egress unit 314 for support during egress from the hospital bed 310.

Figure 10:
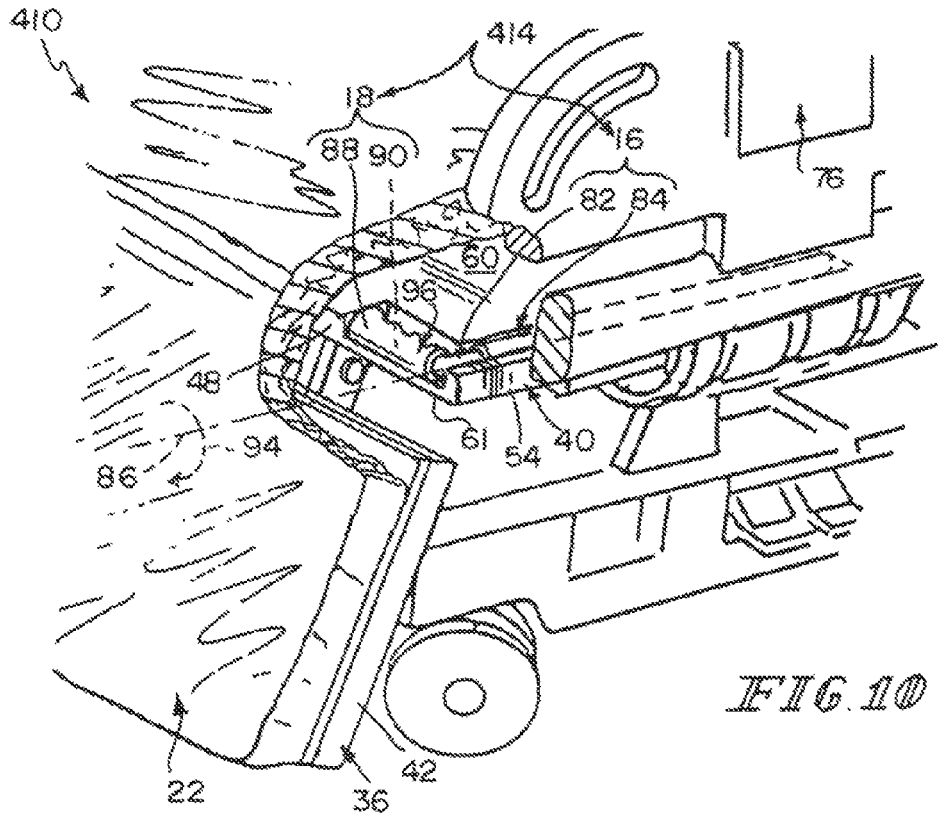
FIG. 10 is an enlarged partial perspective view of another embodiment of an egress unit in a storage position.
Figure 11:
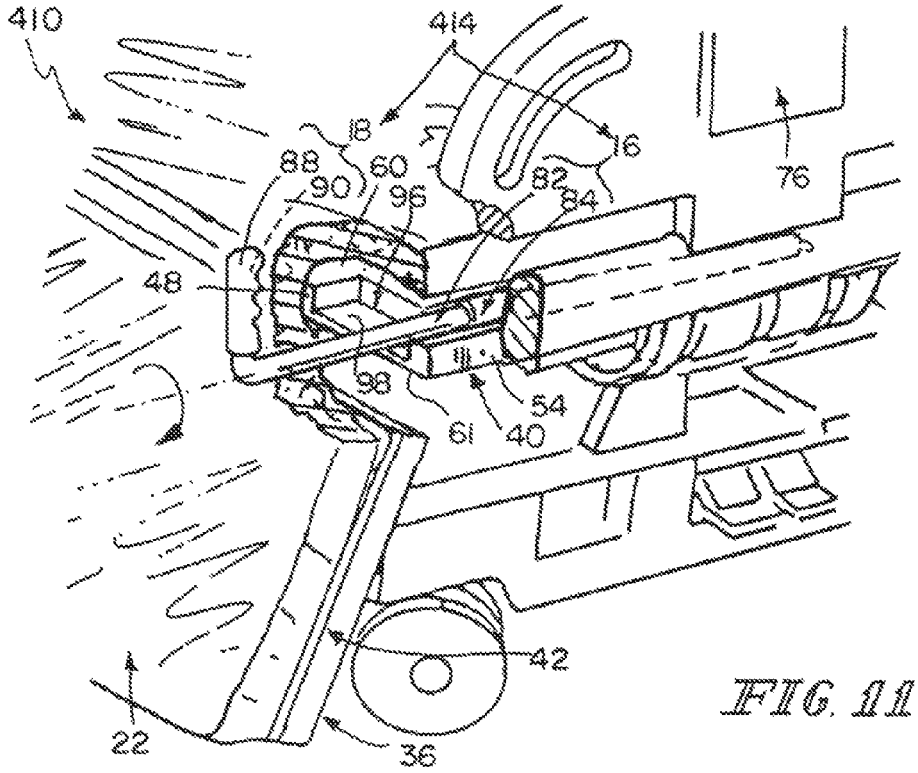
FIG. 11 is a view similar to FIG. 10 with the egress unit in an egress position.

Another embodiment of an egress unit 414 is shown in FIGS. 10 and 11. The egress units 14, 214 and 314 are omitted from the hospital bed 410 and replaced with the egress unit 414. The egress unit 414 includes the slide assembly 16 and the egress handle 18 as shown in FIG. 10. The slide assembly 16 is also movable between a retracted position shown in FIG. 10 and an extended position shown in FIG. 11. Similarly, the egress handle 18 is movable between a first position shown in FIG. 10 and a second position shown in FIG. 11. The egress unit 414 assumes a storage position when the handle 18 is in the first position and the slide assembly 16 is in the retracted position as shown in FIG. 10. The egress unit 414 assumes the egress position when the handle 18 is in the second position and the slide assembly 16 is in the extended position as shown in FIG. 11.

As discussed previously, the slide assembly 16 includes the slide tube 82 and the slide-tube receiver 84 as shown in FIGS. 10 and 11. The top surface 60 of the seat section 40 is formed to include a recess 96 that extends downwardly from the top surface 60 toward the bottom surface 61. The recess 96 is configured to receive the slide-tube receiver 84 therein and the slide-tube receiver 84 is coupled to the seat section 40 to remain in the recess 96. The slide tube 82 interconnects the egress handle 18 to the slide assembly 16 to cause the slide tube 82 and the egress handle 18 to move back and forth relative to the slide-tube receiver 84 to establish either the extended position or the retracted position of the slide assembly 16.

The slide assembly 16 is in the retracted position when the slide tube 82 lies in the recess 96 between the foot and the head edges 48, 50 and the egress handle 18 is in confronting relation with a recess surface 98 as shown in FIG. 10. The slide assembly 16 moves from the retracted position and assumes the extended position as a result of the slide tube 82 moving along the axis 86 away from the slide-tube receiver 84 toward the foot end 26 of the hospital bed 410.

The egress handle 18 is movable between the first position shown in FIG. 10 and the second position shown in FIG. 11. When the handle 18 is in the first position, the mount 90 extends away from the slide tube 82 at about a right angle to the axis 86 in a lateral direction. As shown in FIG. 10, the handle 18 extends away from the second longitudinal edge 54 toward the longitudinal axis 132 of the hospital bed 10. The handle 18 moves from the first position to the second position by rotating in the second direction 94 about the axis 86 until the mount 90 of the handle 18 extends away from the slide tube 82 and out of recess 96 in the upward direction. Put another way, the handle 18 is at nine o'clock when in the first position and moves about the axis 86 in the second direction 94 about 90 degrees until the handle 18 is at 12 o'clock and in the second position when viewed from the foot end 26 of the hospital bed 10.

A caregiver 130 may use the egress unit 414 when a patient egresses from the hospital bed 410 by way of the chair-egress position. As an example of use, the hospital bed 410 begins in the bed position with the egress unit 414 in the storage position. The hospital bed 410 is then moved from bed position to the egress position and a portion of the mattress associated with the foot section 42 and the seat section 40 is deflated. Next, the caregiver 130 moves the mattress 22 away from the egress unit 414 to expose the egress unit 414. The caregiver 130 then slides the slide assembly 16 from the retracted position to the extended position. Finally, the caregiver 130 moves the egress handle 18 from the first position shown in FIG. 410 to the second position shown in FIG. 11 so that a patient may use the egress unit 414 to egress from the hospital bed 410.

Figure 12:
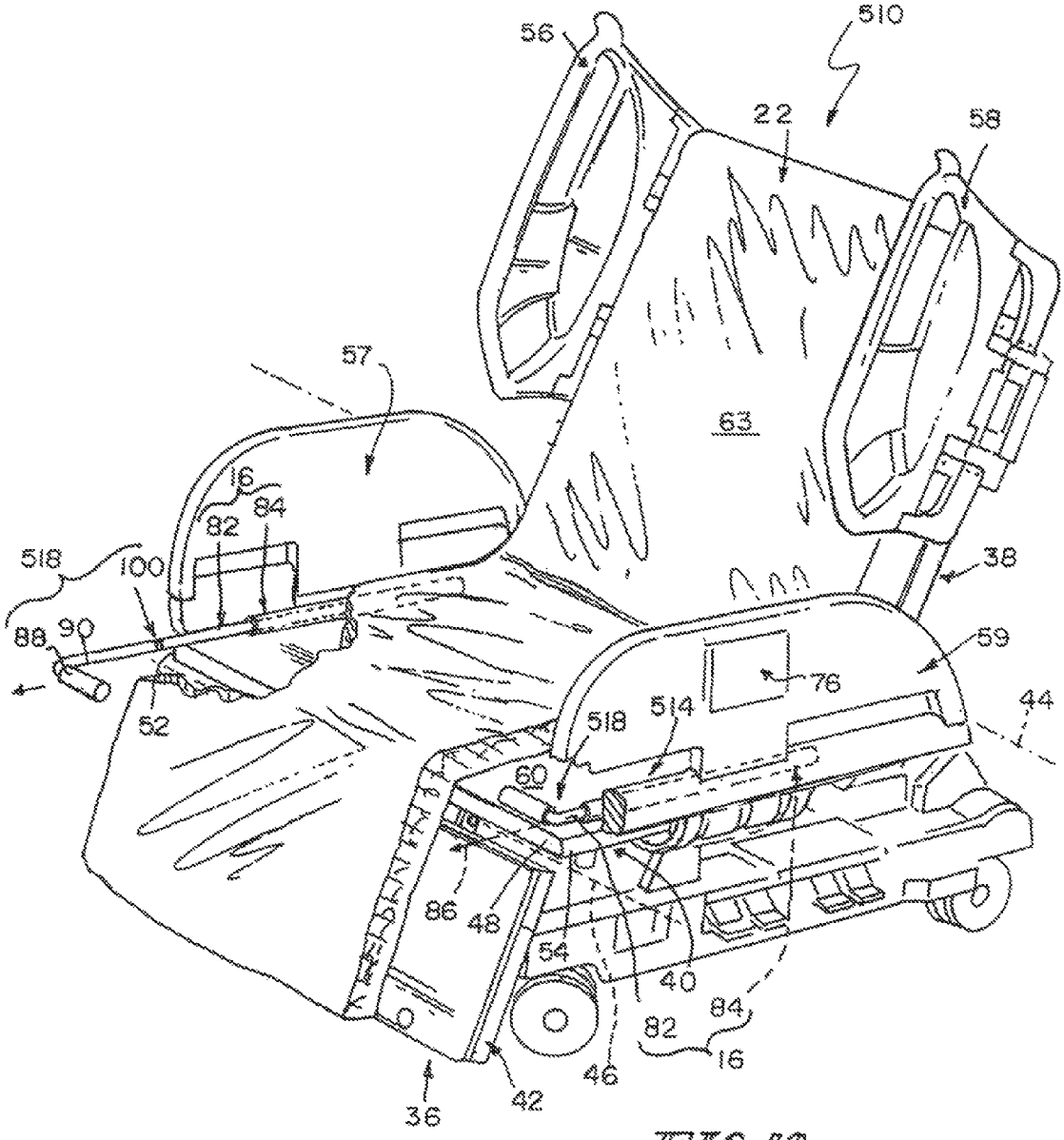
FIG. 12 is an enlarged partial perspective view of another embodiment of an egress unit with a patient-left egress unit in a storage position and a portion of a patient-right egress unit in an extended position.
Figure 13:
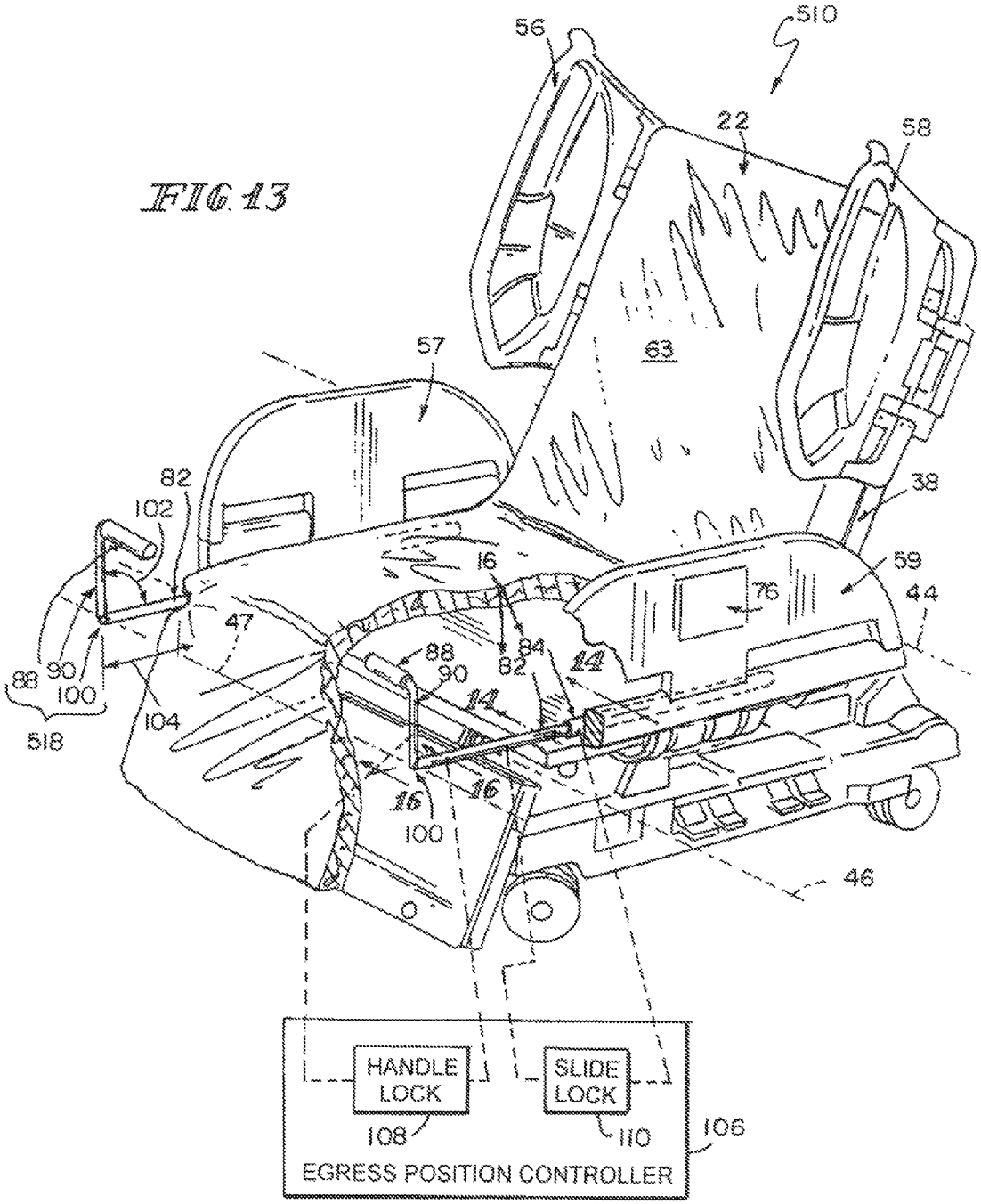
FIG. 13 is a view similar to FIG. 12 with both egress units in an egress position.

Another embodiment of an egress unit 514 is shown in FIGS. 12 and 13. The egress units 14, 214, 314 and 414 are omitted from the hospital bed 510 and replaced with the egress unit 514. The egress unit 514 includes the slide assembly 16 and the egress handle 518 as shown in FIG. 12. The slide assembly 16 is also movable between a retracted position shown in FIG. 12 and an extended position shown in FIG. 13. Similarly, the egress handle 518 is movable between a first position shown in FIG. 12 and a second position shown in FIG. 13. The egress unit 514 assumes a storage position when the handle 518 is in the first position and the slide assembly 16 is in the retracted position as shown in FIG. 12. The egress unit 514 assumes the egress position when the handle 518 is in the second position and the slide assembly 16 is in the extended position as shown in FIG. 13.

As discussed previously, the slide assembly 16 includes the slide tube 82 and the slide-tube receiver 84 as shown in FIGS. 12 and 13. The slide-tube receiver 84 is coupled to the top surface 60 of the seat section 40 to move therewith. The slide tube 82 interconnects the egress handle 518 to the slide assembly 16 to cause the slide tube 82 and the egress handle 518 to move back and forth relative to the slide-tube receiver 84 to establish either the extended position or the retracted position of the slide assembly 16.

The slide assembly 16 is in the retracted position when the slide tube 82 lies between the foot and the head edges 48, 50 and the egress handle 518 is in confronting relation with the top surface 60 as shown in FIG. 12. The slide assembly 16 moves from the retracted position and assumes the extended position as a result of the slide tube 82 moving along the axis 86 away from the slide-tube receiver 84 toward the foot end 26 of the hospital bed 510.

The egress handle 518 includes a grip 88, a mount 90, and a handle joint 100 as shown in FIGS. 12 and 13. The handle joint 100 interconnects the mount 90 and the slide assembly 16 to cause the grip 88 and the mount 90 to pivot about a third lateral pivot axis 47 between the first position shown in FIG. 12 and the second position shown in FIG. 13. When the handle 518 is in the first position, the mount 90 is generally aligned with the slide tube 82 along the axis 86 and the grip 88 extends away from the mount 90 at about 90 degrees so that the grip 88 is generally parallel to and spaced-apart from the third lateral pivot axis 47. The handle 518 moves from the first position to the second position by rotating in the second direction 94 about the third lateral pivot axis 47 away from the foot section 42 toward the head section 38. When the handle 518 achieves the second position, the mount 90 extends upwardly away from the slide tube 82 to define an angle 102 of about 90 degrees therebetween. The grip 88 extends away from the mount 90 at about 90 degrees in the lateral direction is spaced-apart above the third lateral pivot axis 47 as shown in FIG. 13. The third lateral pivot axis 47 is generally spaced-apart from and generally parallel to the first and the second lateral pivot axes 44, 46.

The egress unit 514 is in the egress position when the handle 518 is in the second position and the slide assembly 16 is extended position. The handle 518 cooperates with the top surface 63 of a foot portion of the mattress 22 to define a distance 104. The distance 104 is sufficiently large enough to permit a patient to stand up from the hospital bed 10 and have the patient's legs be positioned between the handle 518 and the top surface 63 of the of a foot portion of the mattress 22.

The egress unit 514 also includes an egress position controller 106 as shown in FIG. 13. A caregiver uses the egress position controller 106 to retain the slide assembly 16 in the retracted position of FIG. 12, the extended position of FIGS. 12 and 13, or any of a number of positions therebetween, and the egress handle 518 in the first position of FIG. 12, the second position of FIG. 13, or any of a number of positions therebetween. Though the egress position controller is shown included in egress unit 514, the egress position controller may be included in egress units 14, 214, 314, and 414.

A caregiver uses the handle 518 and the slide assembly 16 by disengaging the egress position controller 106. The egress position controller 106 includes a handle lock 108 and a slide lock 110 as shown diagrammatically in FIG. 13. The handle lock 108 is used to block movement of the handle 518 relative to the slide assembly 16. The slide lock 110 is used to block movement of the handle 518 relative to the seat section 40. To re-arrange the egress unit 514, a caregiver first moves the slide lock 110 from a locked position in which movement of the slide assembly 16 is blocked to the freed position in which the slide assembly 16 is permitted to move from the retracted position to the extended position. After the slide assembly 16 is in the extended position, the caregiver re-engages the slide lock 110. Next, the caregiver moves the handle lock 108 from a locked position in which rotation of the handle 518 is blocked to the freed position in which the handle 518 is permitted to rotate about the third lateral pivot axis 47 relative to the slide tube 82 from the first position to the second position. Finally, the caregiver re-engages the handle lock 108 so that unintended movement of the handle 518 is blocked.

Figure 14:
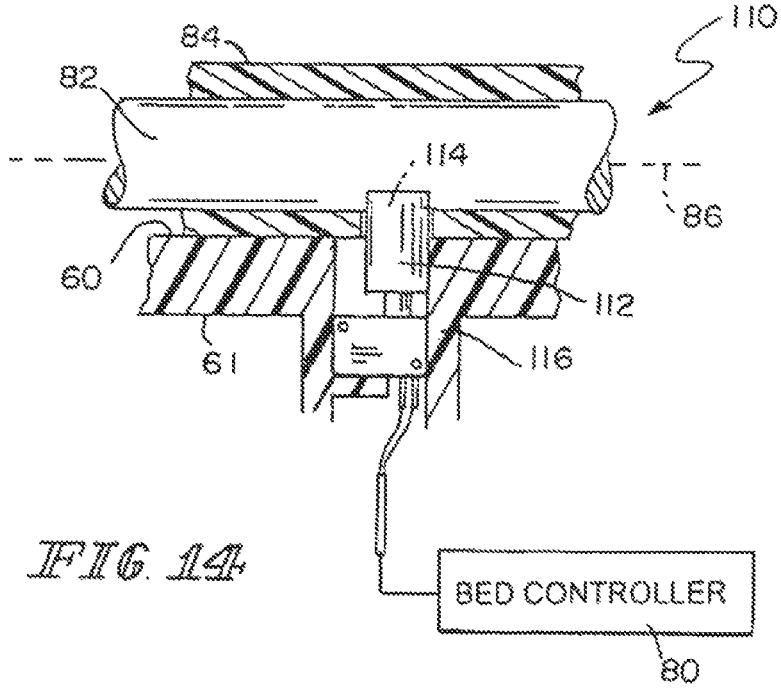
FIG. 14 is a sectional view taken along line 14-14 of FIG. 13 showing a slide lock in a locked position.
Figure 15:
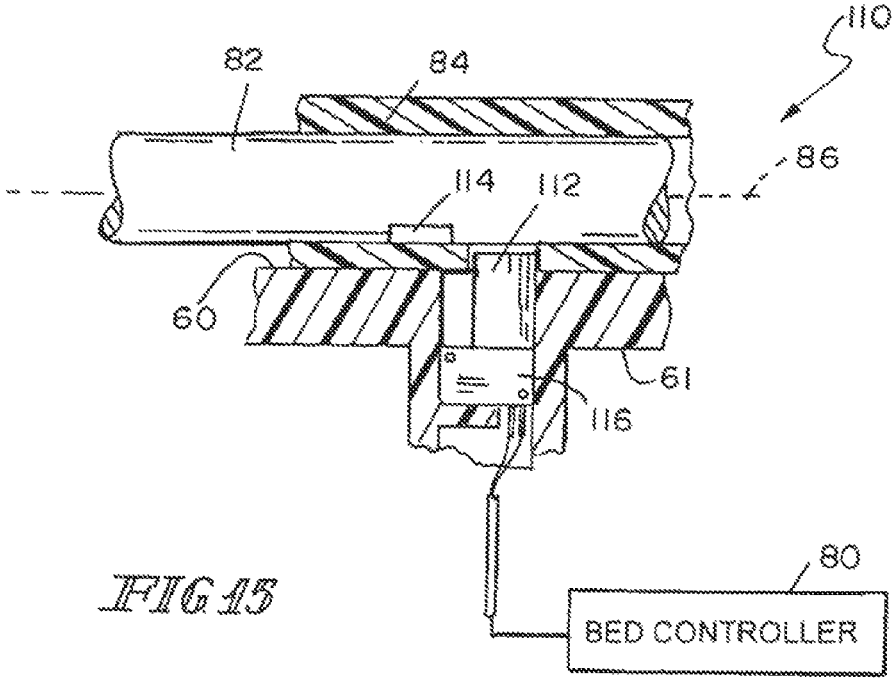
FIG. 15 is a view similar to FIG. 14 with the slide lock in the freed position.

The slide lock 110 is movable between the locked position shown in FIG. 14 in which the slide tube 82 is blocked from moving relative to the slide-tube receiver 84 and the freed position shown in FIG. 15 in which the slide tube 82 is permitted to slide relative to the slide-tube receiver 84. The slide lock 110 includes a piston 112, a notch 114, and a slide-lock actuator 116. The notch 114 is formed in the slide tube 82 and is configured to mate selectively with the piston 112 therein. The slide-lock actuator 116 is coupled to the piston 112 and is configured to move the piston 112 back and forth relative to the notch 114 as shown in FIGS. 14 and 15. The slide-lock actuator 116 is a solenoid coupled electrically to the bed controller 80. The caregiver or the patient uses one of the user interfaces 76, 78 to command the bed controller 80 to cause the solenoid to move the piston 112 to the user desired position. While the slide-lock actuator 116 is shown as a solenoid, a mechanical actuator that uses an actuation force provided by a user may be used.

As shown in FIG. 14, the slide lock 110 is in the locked position when the piston 112 is in mating contact with the notch 114. The caregiver uses the user interface to command the bed controller 80 to cause the slide-lock actuator 116 to move the piston 112 away from notch 114 so that the slide lock 110 assumes the freed position as a result. The caregiver is now able to slide the egress handle 518 away from the slide-tube receiver 84 from the first position to the second position. The caregiver next commands the slide-lock actuator 116 to move toward another notch formed in the slide tube 82 so that the slide lock 110 assumes the locked position and blocks sliding movement of the egress handle 518 relative to the slide-tube receiver 84.

Figure 16:
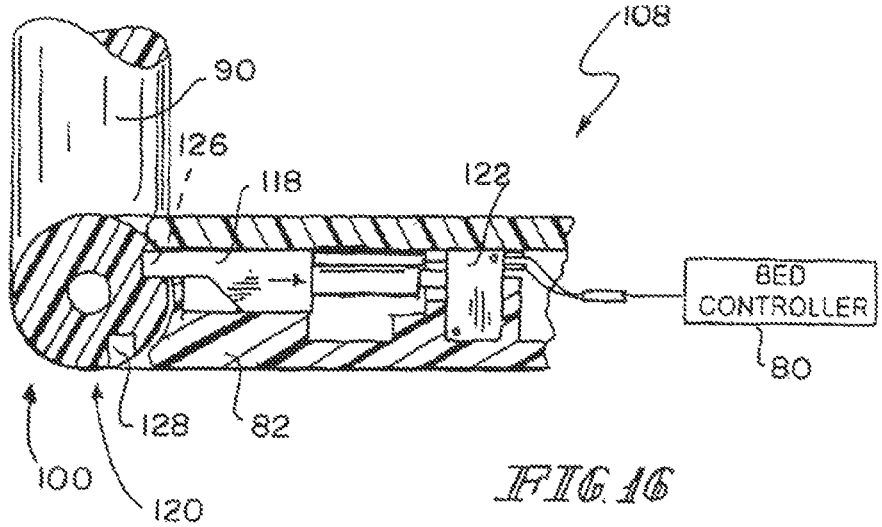
FIG. 16 is a sectional view taken along line 16-16 of FIG. 13 showing a handle lock in a locked position.
Figure 17:
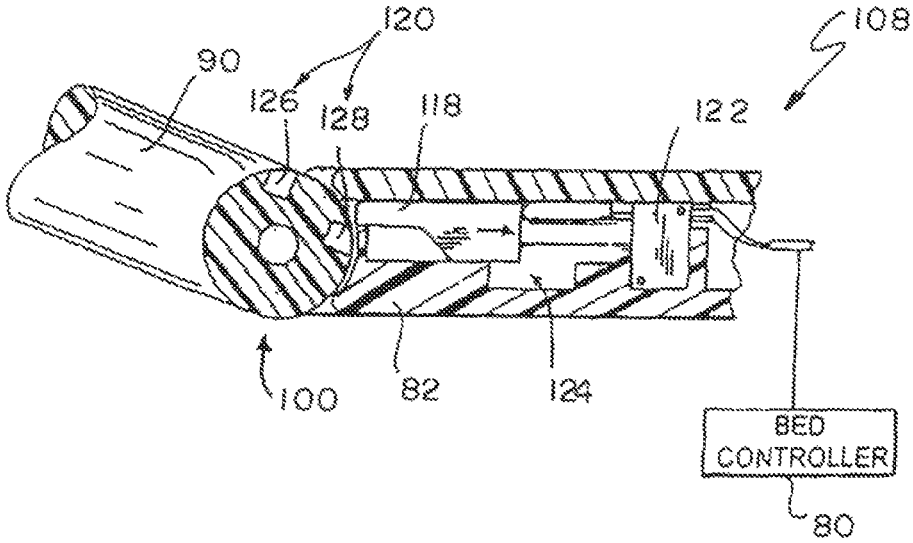
FIG. 17 is a view similar to FIG. 16 with the handle lock in a freed position.

The handle lock 108 is next moved from the locked position shown in FIG. 16 to the freed position shown in FIG. 17. The handle lock 108 includes a plunger 118, a receiver 120, and a handle-lock actuator 122 as shown in FIGS. 16 and 17. The plunger 118 lies in a space 124 formed in the slide tube 82 and mates with the receiver 120 when the handle lock 108 is in the locked position and is spaced-apart from the receiver 120 when the handle lock 108 is in the freed position. As shown in FIG. 16, the receiver 120 includes two slots 126 and 128 that are formed in the handle joint 100 of the egress handle 518. As shown in FIG. 16, the first slot 126 is at about the two o'clock position and is associated with the handle 518 being in the second position. As also shown in FIG. 16, the second slot 128 is at about the five o'clock position and is associated with the handle 518 being in the first position as shown in FIG. 13 and viewed from a patient-left side of the hospital bed 10. The handle-lock actuator 122 is a solenoid that is coupled electrically to the bed controller 80. The caregiver or the patient uses one of the user interfaces 76, 78 to command the bed controller 80 to cause the solenoid to move the plunger 118 to the user desired position. While the handle-lock actuator 122 is shown as a solenoid, a mechanical actuator that uses an actuation force provided by a user may be used.

A caregiver commands the handle-lock actuator 122 to assume the freed position by moving the plunger 118 away from the receiver 120. After the plunger 118 has moved away from the receiver 120, the handle 518 may move between the first position and the second position. After the handle 518 is in the desired position, the caregiver again commands the handle-lock actuator 122 to assume the locked position by moving the plunger 118 back to mate with the receiver 120.

The illustrative hospital beds 10, 210, 310, 410, and 510 are a so-called chair egress bed, in that they are movable between a bed position, as shown in FIG. 1, and a chair-egress position as shown in FIG. 2. However the teachings of this disclosure are applicable to all types of hospital beds, including those that are incapable of achieving a chair-egress position. Some hospital beds are only able to move into a chair-like position, sometimes referred to by those in the art as a "cardiac chair position," and this disclosure is equally applicable to those types of beds. Furthermore, the teachings of this disclosure are applicable to other types of patient support apparatuses such as stretchers, motorized chairs, operating room (OR) tables, specialty surgical tables such as orthopedic surgery tables, examination tables, and the like.

Although certain illustrative embodiments have been described in detail above, variations and modifications exist within the scope and spirit of this disclosure as described and as defined in the following claims.

The invention claimed is:

1. A patient support apparatus comprising a base, a frame coupled to the base, the frame being movable relative to the base, a deck supported by the frame and movable relative to the frame between a horizontal position and an articulated position, the deck including at least a head section, a foot section spaced-apart from the head section, and a seat section positioned between the head section and the foot section, and the foot section being pivotable about a first lateral pivot axis relative to the frame, and an egress unit coupled to the seat section of the deck and movable between an egress position in which the egress unit extends in an upward direction away from the deck to support a patient's weight so that a patient can egress from the patient support apparatus when the deck is in the articulated position and a storage position in which the egress unit is arranged to lie in confronting relation with the deck, wherein the egress unit includes a handle and a slide assembly and the handle is arranged to translate along a second axis that is generally perpendicular to the first lateral pivot axis and rotate about the second axis when the egress unit moves between the egress position and the storage position.

2. The patient support apparatus of claim 1, wherein the slide assembly is arranged to lie between and to interconnect the handle to the seat section of the deck, the slide assembly is movable between a retracted position in which the handle is positioned adjacent to a foot edge of the seat section and an extended position in which the handle has moved away from the seat section in a longitudinal direction to lie in spaced-apart relation to the foot edge of the seat section.

3. The patient support apparatus of claim 2, wherein the handle rotates about the second axis between a first position in which the handle extends in a downward direction away from a bottom surface of the seat section and a second position in which the handle extends away from a top surface of the seat section in an upward direction.

4. The patient support apparatus of claim 3, wherein the slide assembly includes a slide tube coupled to the handle to move therewith and a slide-tube receiver coupled to the seat section to move therewith, the slide-tube receiver is configured to support the slide tube therein for back-and-forth movement of the slide tube generally parallel to a longitudinal axis of the bed along the axis.

5. The patient support apparatus of claim 2, wherein the handle is movable about the second axis between a first position in which the handle extends in a direction that is generally perpendicular to a longitudinal axis of the patient support apparatus and a second position in which the handle extends away from a top surface of the seat section in an upward direction.

6. The patient support apparatus of claim 5, wherein the slide assembly includes a slide tube coupled to the handle to move therewith and a slide-tube receiver coupled to the seat section to move therewith, the slide-tube receiver is configured to support the slide tube therein for back-and-forth movement along the second axis between the extended and retracted position.

7. The patient support apparatus of claim 6, wherein the slide-tube receiver is coupled to a top surface of the seat section and the handle lies in a plane generally parallel to the top surface when the slide assembly is in the retracted position and the handle is in the first position.

8. The patient support apparatus of claim 6, wherein the slide-tube receiver is coupled to a bottom surface of the seat section and the bottom surface is spaced-apart from the top surface and arranged to face in the downward direction.

9. The patient support apparatus of claim 1, wherein the recess opens in a downward direction away from the top surface.

10. A patient support apparatus comprising a base, a frame coupled to the base, the frame being movable relative to the base, a deck supported by the frame and movable relative to the frame between a horizontal position and an articulated position, the deck including at least a head section, a foot section spaced-apart from the head section, and a seat section positioned between the head section and the foot section, and the foot section being pivotable about a first lateral pivot axis relative to the frame, and an egress unit coupled to the seat section of the deck and movable between an egress position in which the egress unit extends in an upward direction away from the deck to support a patient's weight so that a patient can egress from the patient support apparatus when the deck is in the articulated position and a storage position in which the handle is arranged to lie in confronting relation with the deck, wherein the egress unit includes a handle and a slide assembly arranged to lie between and to interconnect the handle to the seat section of the deck, the slide assembly is movable between a retracted position in which the handle is positioned adjacent to a foot edge of the seat section and an extended position in which the handle has moved away from the seat section in a longitudinal direction to lie in spaced-apart relation to the foot edge of the seat section, wherein the handle is movable about an axis between a first position in which the handle extends in a direction that is generally perpendicular to a longitudinal axis of the patient support apparatus and a second position in which the handle extends away from a top surface of the seat section in an upward direction, wherein the slide assembly includes a slide tube coupled to the handle to move therewith and a slide-tube receiver coupled to the seat section to move therewith, the slide-tube receiver is configured to support the slide tube therein for back-and-forth movement along the axis between the extended and retracted position, and wherein the seat section is formed to include a recess that opens in a downward direction away from the top surface, the egress unit is arranged to lie in the recess and lie below the top surface when the slide assembly is in the retraced position and the handle is in the first position.

11. A patient support apparatus comprising a base, a frame coupled to the base, the frame being movable relative to the base, a deck supported by the frame and movable relative to the frame between a horizontal position and an articulated position, the deck including at least a head section, a foot section spaced-apart from the head section, and a seat section positioned between the head and foot sections, the seat section including a foot edge, an oppositely spaced-apart head edge, a first longitudinal edge arranged to extend between the foot and the head edges, and an opposite second longitudinal edge arranged in spaced-apart generally parallel relation to the first longitudinal edge, and the foot section being pivotable about a first lateral pivot axis relative to the frame, a siderail coupled the frame between the head edge and the foot edge of the seat section and arranged to extend along one of the first and second longitudinal edges of the seat section, a slide assembly including a slide-tube receiver coupled to the seat section in a fixed position and a slide tube coupled to the slide-tube receiver to translate along an axis relative to the slide-tube receiver, the slide assembly is in a retracted position when the slide tube lies between the foot and the head ends of the seat section, and the slide assembly is in an extended position when the slide tube has translated along the axis away from the foot and the head edges of the seat section toward a foot end of the patient support apparatus, and a handle coupled to the slide tube to move therewith about the axis, the handle being movable relative to the slide-slide tube receiver about a pivot axis when the slide tube is in the extended position from a first position in which the handle extends generally perpendicularly away from the axis to define an angle measured in a second direction between a horizontal plane that is generally coplanar with the axis and the handle and the angle is between about 0 degrees and about 180 degrees, and a second position in which the handle extends in an upward direction away from the axis.

12. The patient support apparatus of claim 11, wherein the slide-tube receiver is coupled to a top surface of the seat section.

13. The patient support apparatus of claim 12, wherein the handle extends away from a longitudinal axis of the patient support apparatus towards the siderail when the handle is in the first position.

14. The patient support apparatus of claim 12, wherein the handle is coupled to the longitudinal edge to extend away from the longitudinal edge toward the siderail and the handle is positioned to lie between the longitudinal edge and the siderail.

15. The patient support apparatus of claim 11, wherein the slide-tube receiver is coupled to a bottom surface of the seat section.

16. The patient support apparatus of claim 11, wherein the top surface of the seat section is formed to include a recess, the recess is configured to receive the egress unit therein when the slide assembly is in the retraced position and the handle is in the first position.

17. The patient support apparatus of claim 11, wherein handle includes a grip adapted to be grasped by a patient during egress from the patient support apparatus, a mount coupled on a first end to the grip, and a handle joint arranged to interconnect an opposite second end of the mount to the slide assembly to cause the mount and the grip to move about the pivot axis between a first position in which the mount is generally aligned with the slide assembly and a second position in which the mount extends in an upward direction away from the slide tube and is about perpendicular to the slide tube.

18. A patient support apparatus comprising a base, a frame coupled to the base, the frame being movable relative to the base, a deck supported by the frame and movable relative to the frame between a horizontal position and a chair-egress position, the deck including a head section, a foot section spaced-apart from the head section, and a seat section positioned between the head and foot sections, the seat section including a foot edge, an opposite head edge, and a longitudinal edge extending between the head and foot edges, and the head section being arranged to pivot upwardly about a first lateral pivot axis relative to the seat section and the foot section being arranged to pivot downwardly about a second lateral pivot axis relative to seat section when the deck is in the chair-egress position, a slide assembly including a slide-tube receiver coupled to the longitudinal edge of the seat section in a fixed position to extend away from the seat section in a lateral direction and a slide tube coupled to the slide-tube receiver to translate along an axis relative to the slide-tube receiver, the slide assembly being in a retracted position when the slide tube lies between the foot and the head ends of the seat section, and the slide assembly being in an extended position when the slide tube has translated along the axis away from the foot and the head edges of the seat section toward a foot end of the patient support apparatus, and a handle coupled to the slide tube to translate back and forth with the slide tube about the axis, the handle being movable relative to the slide tube about a third lateral pivot axis when the slide assembly is in the extended position from a first position in which the handle is generally aligned with the slide tube and a second position in which the handle extends in an upward direction away from the slide tube, and wherein the third lateral pivot axis is generally parallel to the first and second lateral pivot axes.

19. A patient support apparatus comprising a base, a frame coupled to the base, the frame being movable relative to the base, a deck supported by the frame and movable relative to the frame between a horizontal position and a chair-egress position, the deck including a head section, a foot section spaced-apart from the head section, and a seat section positioned between the head and foot sections, the seat section including a foot edge, an opposite head edge, and a longitudinal edge extending between the head and foot edges, and the head section being arranged to pivot upwardly about a first lateral pivot axis relative to the seat section and the foot section being arranged to pivot downwardly about a second lateral pivot axis relative to seat section when the deck is in the chair-egress position, a slide assembly including a slide-tube receiver coupled to the seat section in a fixed position and a slide tube coupled to the slide-tube receiver to translate along an axis relative to the slide-tube receiver, the slide assembly being in a retracted position when the slide tube lies between the foot and the head ends of the seat section, and the slide assembly being in an extended position when the slide tube has translated along the axis away from the foot and the head edges of the seat section toward a foot end of the patient support apparatus, and a handle coupled to the slide tube to translate back and forth with the slide tube about the axis, the handle being movable relative to the slide tube about a third lateral pivot axis when the slide assembly is in the extended position from a first position in which the handle is generally aligned with the slide tube and a second position in which the handle extends in an upward direction away from the slide tube.

20. The patient support apparatus of claim 19, wherein the handle includes a grip adapted to be grasped by a patient during egress from the patient support apparatus, a mount coupled on a first end to the grip, and a handle joint arranged to interconnect an opposite second end of the mount to the slide assembly to cause the mount and the grip to move about an axis between a first position in which the mount is generally aligned with the slide assembly and a second position in which the mount extends in an upward direction away from the slide and is about perpendicular to the slide assembly.

21. The patient support apparatus of claim 20, wherein the axis is generally parallel to the second lateral pivot axis.

22. The patient support apparatus of claim 21, wherein the handle joint defines the axis, the handle joint is between the foot edge and an opposite head edge of the seat section when the slide assembly is in the retracted position, and the handle joint moves away from the foot edge and the head edge to lie spaced-apart from the foot edge when the slide assembly is in the extended position.

* * * * *